US006202900B1

(12) United States Patent
Tsutsui et al.

(10) Patent No.: US 6,202,900 B1
(45) Date of Patent: Mar. 20, 2001

(54) DISPENSING VALVE FOR AN AEROSOL-TYPE CONTAINER ENABLING GASEOUS FLUID RECHARGING

(75) Inventors: Tatsuo Tsutsui, Kanagawa; Akira Yanagawa, Yokohama, both of (JP)

(73) Assignees: Unisia Jecs Corporation, Atsugi; Dott Limited Company, Yokohama, both of (JP)

( * ) Notice: Subject to any disclaimer, the term of this patent is extended or adjusted under 35 U.S.C. 154(b) by 0 days.

(21) Appl. No.: 09/403,369

(22) PCT Filed: Apr. 9, 1999

(86) PCT No.: PCT/JP99/01884

§ 371 Date: Oct. 21, 1999

§ 102(e) Date: Oct. 21, 1999

(87) PCT Pub. No.: WO99/54230

PCT Pub. Date: Oct. 28, 1999

(30) Foreign Application Priority Data

Apr. 21, 1998 (JP) ..... 10-110267

(51) Int. Cl.[7] ..... B65D 83/42; B65D 83/54
(52) U.S. Cl. ..... 222/402.2; 222/394; 222/402.16
(58) Field of Search ..... 222/394, 402.1, 222/402.16, 402.2

(56) References Cited

U.S. PATENT DOCUMENTS 2,968,427 1/1961 Meshberg ..... 222/394
3,464,596 9/1969 Meshberg ..... 222/402.2
4,506,803 * 3/1985 Franklin et al. ..... 222/402.2
4,863,073 * 9/1989 Burt et al. ..... 222/402.2

FOREIGN PATENT DOCUMENTS 8-141450 6/1996 (JP) .

* cited by examiner

*Primary Examiner*—J. Casimer Jacyna
(74) *Attorney, Agent, or Firm*—Foley & Lardner

(57) ABSTRACT

A gas injection valve comprises a valve casing fitted to a gas bottle, a valve pin slidably received in the valve casing, first and second seal rings fitted to the inner peripheral wall of the valve casing, and a fixed-quantity chamber defined between the first and second seal rings for capturing therein a fixed amount of gas before injection. The valve pin has a gas passage bore for intercommunicating a first port formed in the upper face of the tip of the valve pin and a second port formed in the outer peripheral wall of the valve pin. The second port is located to open into the substantially cylindrical hollow of the casing above the second seal ring with the valve pin kept in a lifted-up position and to open into the fixed-quantity chamber below the second seal ring during one-step pushing action and two-step pushing action of the valve pin. A first bypass portion is formed in the valve pin for intercommunicating the interior of the gas bottle and the fixed-quantity chamber through a partial space of the substantially cylindrical hollow near the first seal ring in the lifted-up position of the valve pin. A second bypass portion is formed in the valve pin for intercommunicating the interior of the gas bottle and the fixed-quantity chamber through the partial space of the substantially cylindrical hollow near the first seal ring only during the two-step pushing action.

7 Claims, 7 Drawing Sheets

DISPENSING VALVE FOR AN AEROSOL-TYPE CONTAINER ENABLING GASEOUS FLUID RECHARGING

This application is a 371 of international application number PCT/JP99/01884, filed Apr. 9, 1999.

TECHNICAL FIELD

The invention relates to a gas injection valve used for injecting or atomizing contents or agent, such as a medicine, a paint, or the like, charged within a gas bottle, utilizing a jet of high-pressure gas such as liquefied carbon dioxide gas, serving as a propellant, and specifically to an improved gas injection valve which enables the recycling of the gas bottle.

BACKGROUND ART

An injection device, where a gas bottle is charged with both high-pressure gas and contents such as a medicine, and the contents are injected from a gas injection valve fixedly provided in the opening portion of the gas bottle under gas pressure, is conventionally used. Hitherto, this type of the conventional injection device uses specified chloro-fluoro-carbon gas as a propellant. Due to an increased interest in environmental protection, there is the today's trend that the previously-noted specified chloro-fluoro-carbon gas is replaced by alternative chloro-fluoro-carbon gas such as HFC134a. Such alternative chloro-fluoro-carbon gas such as HFC134a exerts an influence on an ozone layer, but its influence on global warming is 1000 or more times greater than $CO_2$. Pre-estimatedly, the increased tendency of using alternative chloro-fluoro-carbon gas maybe poses a new problem. For the reasons set forth above, more recently, there has been proposed and developed the use of various gases suitable for a propellant of an injection device, such as carbon dioxide gas, nitrogen gas, or inert gas (for example helium, neon, krypton, xenon, radon or the like), all gases having a less influence on depletion of ozonosphere and global warming. In case that either the above-mentioned gases is used as a propellant of the injection device, it is desirable to reduce the size of a gas bottle by way of liquefaction of gas to be charged in the same manner as chloro-fluoro-carbon gas liquefied for the propellant purpose. For example, in case of the use of liquefied carbon dioxide gas, its vapor pressure reaches 60 kgf/cm$^2$ at 20° C. In case of the use of inert gas, in order to increase a volumetric efficiency it is preferable to use a highly-pressurized, or liquefied inert gas. In the last analysis, it is desirable to use high-pressure gas having a pressure level of 50 kgf/cm$^2$ or more. Such a conventional high-pressure gas injection valve has been disclosed in Japanese Patent Provisional Publication No. 8-141450.

FIG. 10 shows the conventional gas injection device disclosed in the previously-described Japanese Patent Provisional Publication, where a valve pin 3 is slidably received in a valve casing 2 fixedly connected to the opening portion 1*a* of a gas bottle 1, first and second seal rings 4 and 5 are in axially spaced relationship with each other and fitted to the interior of the valve casing 2, and a fixed-quantity chamber 6 is defined in a portion sandwiched by both the first and second seal rings 4 and 5 for capturing therein a fixed amount of gas before injection. Furthermore, a first valve portion 7 is provided at the lower end of the valve pin 3, so that the first valve portion is fitted to or brought into contact with the inside of the first seal ring 4 in a fluid-tight fashion when the valve pin 3 is pushed from the outside. Also provided at the upper end of the valve pin 3 is a second valve portion 8, which comprises a large-diameter portion 8*a* fitted to or brought into contact with the inside of the second seal ring 5 when the valve pin 3 is kept at its uppermost position, and a small-diameter portion 8*b* cooperating with the second seal ring 5 to define an aperture therebetween when the valve pin 3 is pushed from the outside. In addition to the above, a spring 9 is accommodated in the fixed-quantity chamber, so that the valve pin 3 is permanently biased upwards by means of the return spring 9. With the previously-noted arrangement of the gas injection valve, in a steady state where the valve pin 3 is not pushed from the outside, the large-diameter portion 8*a* of the second valve portion 8 is kept in contact with the inside wall of the second seal ring 5 in a fluid-tight fashion, whereas the first valve portion 7 remains spaced apart from the first seal ring 4. Thus, the interior of the gas bottle 1 communicates with the fixed-quantity chamber 6. When the valve pin 3 is pushed from the outside from such a steady state, the first valve portion 7 is brought into contact with the first seal ring 4 and thereafter the small-diameter portion 8*b* of the second valve portion 8 defines an aperture in cooperation with the second seal ring 5. This permits the contents to be injected together with the gas through the aperture into the exterior of the gas bottle 1. At this time, the first valve portion 7 is fitted to or brought into contact with the first seal ring 4 before the second valve portion 8 and the second seal ring 5 cooperate with each other to define the aperture therebetween, thereby blocking the fluid communication between the fixed-quantity chamber 6 and the interior of the gas bottle 1. This enables the fixed quantity of gas and contents captured in the fixed-quantity chamber 6 to be injected from the gas injection device.

In case that high-pressure gas such as liquefied carbon dioxide gas is used as a propellant of a gas injection device, a more strong structure of a gas bottle and a more strong structure of a gas injection valve are required from the viewpoint of safety. The more strong structure requires so much materials in manufacturing a gas bottle or a gas injection valve, as compared to the current injection device in which specified chloro-fluoro-carbon gas or the like is used as a propellant. For the reasons discussed above, same as at present, it is not preferable to use the injection device only once and then throw it, in view of efficient use of earth resources. However, the previously-described conventional gas injection valve does not have a structure that high-pressure gas and contents such as medicines are recharged into the internal space of the once-used gas bottle 1. Thus, it is impossible to recycle the prior-art gas injection valve and gas bottle 1 having the same structure as at present.

It is, therefore, in view of the previously-described disadvantages of the prior art, an object of the present invention to provide improved technologies for a gas injection valve and an injector adapter used as a gaseous fluid recharging adapter, while being fitted to the gas injection valve, which is capable of easily recharging high-pressure gas into the once-used gas bottle in spite of its simple structure, and of making efficient use of earth resources without introducing an increase in production cost.

DISCLOSURE OF THE INVENTION

In order to accomplish the aforementioned and other objects, according to the invention as claimed in claim 1, a gas injection valve comprises a valve casing adapted to be fitted to an opening portion of a gas bottle and having a substantially cylindrical hollow, a valve pin slidably received in the substantially cylindrical hollow of the valve casing, first and second seal rings axially spaced with each other and fitted to an inner peripheral wall of the valve casing to provide sealing action between the inner peripheral wall of the valve casing and the outer peripheral wall of the valve pin, the first seal ring being located closer to the interior of the gas bottle than the second seal ring, a fixed-quantity chamber defined in an intermediate portion of the substantially cylindrical hollow sandwiched between the first and second seal rings for capturing therein a fixed amount of gas before injection, a gas passage bore formed in the valve pin for intercommunicating a first port formed in the upper face of the tip of the valve pin and a second port formed in the outer peripheral wall of the valve pin and axially spaced apart from the first port a predetermined distance, the second port of the gas passage bore being located to open into the substantially cylindrical hollow above the second seal ring when the valve pin is kept in a lifted-up position and to open into the fixed-quantity chamber below the second seal ring during a one-step pushing action of the valve pin and during a two-step pushing action of the valve pin, a first bypass portion formed in the valve pin for intercommunicating the interior of the gas bottle and the fixed-quantity chamber through a partial space of the substantially cylindrical hollow near the first seal ring only when the valve pin is kept in the lifted-up position, and a second bypass portion formed in the valve pin for intercommunicating the interior of the gas bottle and the fixed-quantity chamber through the partial space of the substantially cylindrical hollow near the first seal ring only during the two-step pushing action. In the gas injection valve made according to the invention defined in claim 1, when the valve pin is maintained in the lifted-up position, the second port of the gas passage bore is positioned above the second seal ring, and thus the fluid communication between the gas passage bore and the fixed-quantity chamber is shut off and at the same time the fixed-quantity chamber is communicated with the interior of the gas bottle through the first bypass portion of the valve pin. When the valve pin is pushed down to the one-step pushing position from such a valve lifted-up state, the fluid communication between the interior of the gas bottle and the fixed-quantity chamber is blocked by means of the first seal ring and in lieu thereof the second port of the valve pin opens into the fixed-quantity chamber to inject or atomize the fixed amount of gas and contents captured in the fixed-quantity chamber via the gas passage bore. Alternatively, in case of gaseous fluid recharging, the tip of the valve pin is first connected to a gas recharging device, and then the valve pin is pushed down to the two-step pushing position. Under this condition, the second port of the valve pin opens into the fixed-quantity chamber, and as a result the fixed-quantity chamber is communicated with the interior of the gas bottle through the second bypass portion of the valve pin, thus permitting high-pressure gas to flow from the gas recharging device through the fixed-quantity chamber and the second bypass portion toward within the interior of the gas bottle.

According to the invention as claimed in claim 2, each of the first and second bypass portions comprises a notched groove partly formed in the outer peripheral wall of the valve pin. Such a notched groove facilitates the machining of the bypass portion of the valve pin.

According to the invention as claimed in claim 3, each of the first and second bypass portions comprises a bypass passage bored in the valve pin to intercommunicate two different points axially spaced with each other and located on the outer peripheral wall of the valve pin. The use of the bypass passage formed in the valve pin reduces the problem of wear and tear of the first seal ring during the axial sliding movement of the valve pin.

According to the invention as claimed in claim 4, the gas injection valve further comprises a nozzle button detachably connected to the tip of the valve pin for atomizing a fixed amount of gas and contents captured in the fixed-quantity chamber and also the nozzle button has a stopper face limiting a pushing stroke of the valve pin to a first specified stroke corresponding to the one-step pushing action. The one-step pushing action of the valve pin, limited by the stopper face of the nozzle button, allows injection or atomization of the fixed amount of gas and contents.

According to the invention as claimed in claim 5, the gas injection valve further comprises a gas-recharging injector adapter detachably connected to the tip of the valve pin in place of the nozzle button for freshly recharging gas and contents, and the gas-recharging injector adapter has a stopper face limiting a pushing stroke of the valve pin to a second specified stroke corresponding to the two-step pushing action. The two-step pushing action of the valve pin, limited by the stopper face of the gas-recharging injector adapter, allows the recharging action of new gas and contents from the recharging device into the gas bottle.

DESCRIPTION OF THE PREFERRED EMBODIMENTS

The present invention will be hereinbelow described in detail in reference to the drawings attached hereto.

Figure 1:
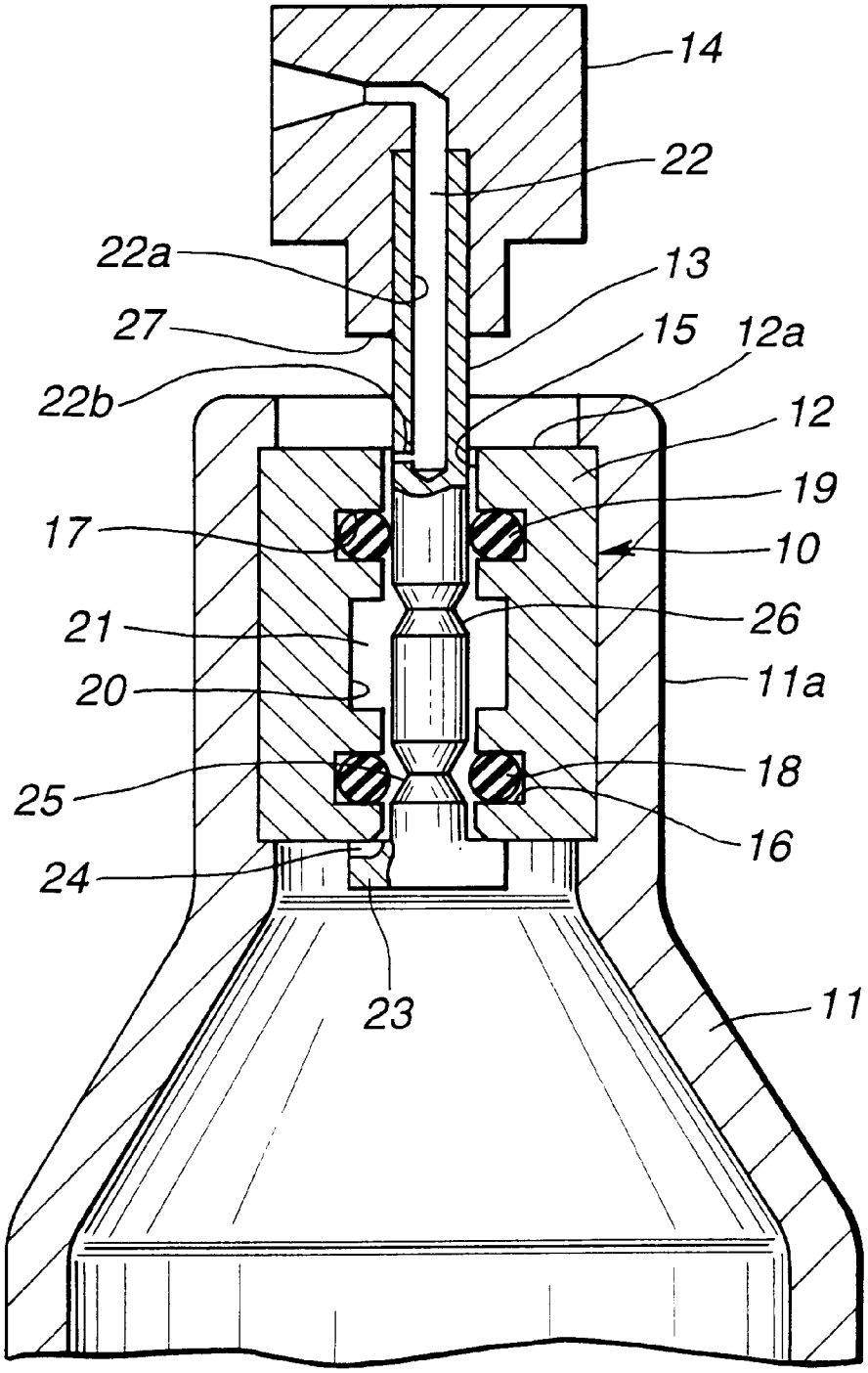
FIG. 1 is a cross-sectional view illustrating a first embodiment of a gas injection valve of the invention.
Figure 2:
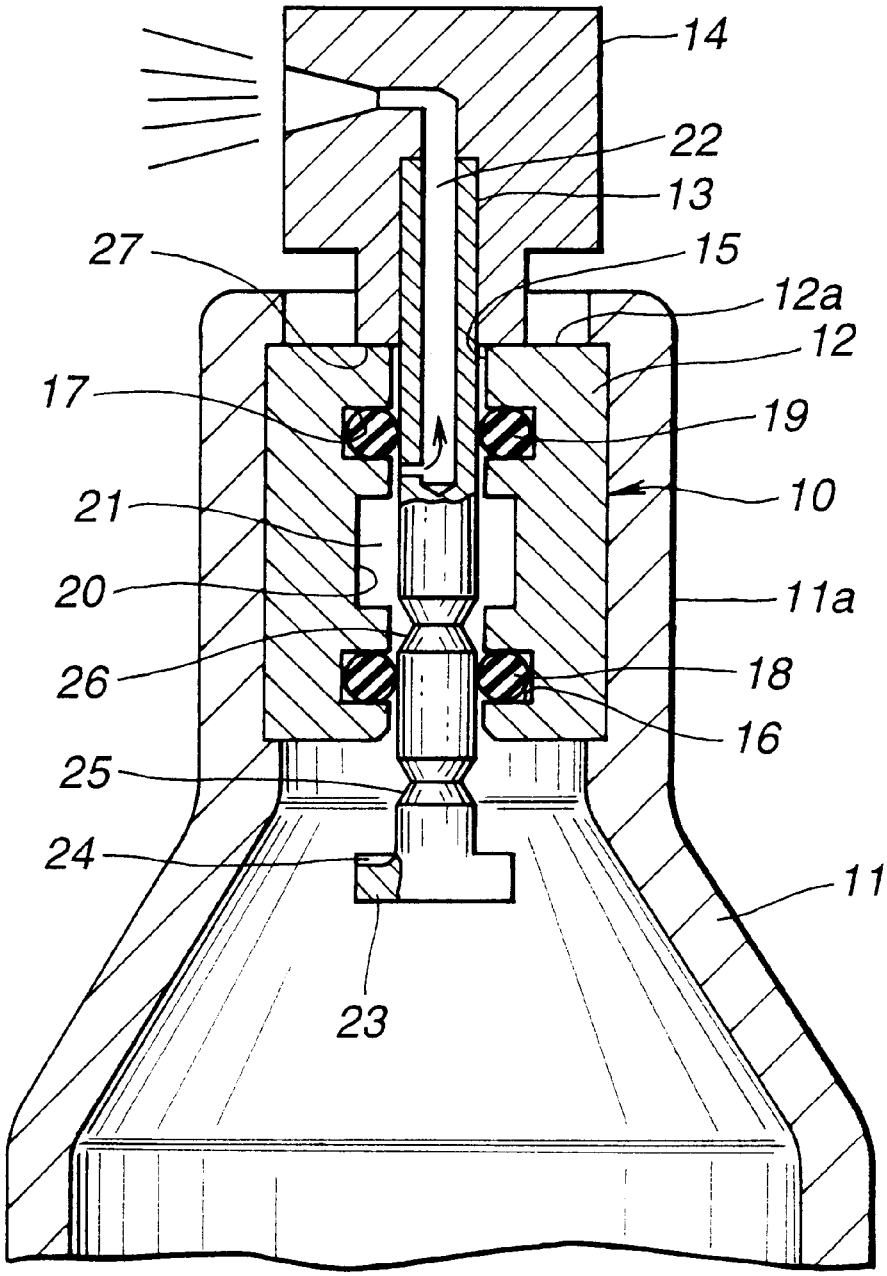
FIG. 2 is a cross-sectional view illustrating the gas injection valve of the first embodiment during one-step push of a valve pin.
Figure 3:
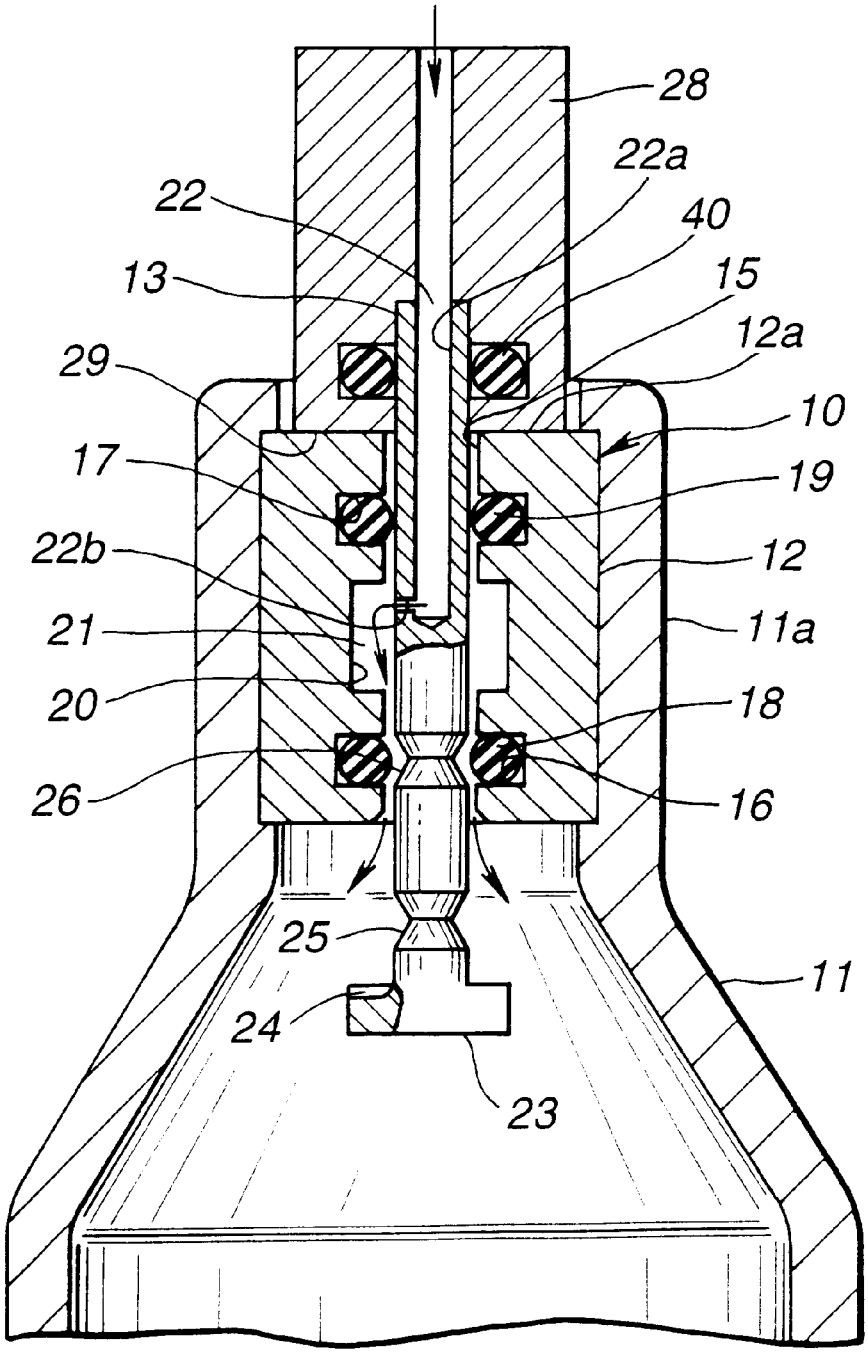
FIG. 3 is a cross-sectional view illustrating the gas injection valve of the first embodiment during two-step push of the valve pin.

Referring now to FIGS. 1 through 3, there is shown an injection device employing a gas injection valve 10 of the first embodiment. In the gas injection device of the embodiment, a gas injection valve 10 is installed in the opening portion 11*a* of a gas bottle charged with high-pressure gas such as liquefied carbon dioxide gas and contents such as a medicine. The gas injection valve 10 comprises a valve casing 12 fixedly connected to the opening portion 11*a* of the gas bottle 11 by way of caulking, and a valve pin 13 slidably received in the valve casing 12. A nozzle button 14, having both a nozzle function and a push-button function, is fitted onto the tip of valve pin 13 projected upwardly from the valve casing 12. The valve casing 12 is formed in its center with an axially-extending guide bore (or a substantially cylindrical hollow) 15 into which the valve pin 13 is fitted. The valve casing fitted to the opening end of the gas bottle 11, has two annular grooves 16 and 17 formed in the guide bore 15 in axially-spaced relationship with each other. First and second seal rings 18 and 19 are respectively fitted in the upper and lower annular grooves 16 and 17 and placed around the axially-slidable valve pin 13 to provide a fluid tight seal or to provide the sealing action. The valve casing also includes an annular recessed portion 20 in the middle of the guide bore 15. An internal space, containing the annular recessed portion 20, is defined between the first and second seal rings 18 and 19 by the outer peripheral wall surface of each of the two seal rings 18 and 19, the outer peripheral wall surface of the valve pin 13, and the inner peripheral wall surface of the guide bore 15 of the valve casing 12. The internal space (the intermediate portion of the guide bore 15 of the valve casing 12), containing the annular recessed portion 20 and defined between the first and second seal rings 18 and 19, serves as a fixed-quantity chamber 21 capable of capturing therein a fixed amount of gas before injection. On the other hand, the valve pin 13 is formed in a substantially center of its tip projected upwardly from the valve casing 12 with a gas passage bore 22 through which a first port located in the uppermost face of the tip of the valve pin 13 is communicated with a second port (located in the valve-pin outer peripheral wall or the valve-pin curved surface) axially spaced apart from the first port a predetermined distance. In more detail, the gas passage bore 22 comprises an axial bore 22*a* axially downward extending from the first port located in the uppermost flat face of the tip of the valve pin 13, and an orifice passageway 22*b* penetrating the outer periphery of the valve pin 13 and radially extending from the downstream end of the axial bore 22*a* to the second port in such a manner as to communicate the lowermost end of the axial bore with the guide bore. The axial bore 22*a* is dimensioned to have a comparatively great inside diameter, whereas the orifice passageway 22*b* is dimensioned to have a predetermined inside diameter (or a specified orifice diameter) less than the diameter of the axial bore 22*a*. The orifice size of the orifice passageway 22*b* determines a gas injection amount per unit hour during the injection period of the gas injection valve 10. Thus, the orifice diameter of the orifice passageway is determined depending on a required gas injection amount per unit hour. When the valve pin 13 is kept at its lifted-up position, the orifice passageway 22*b* opens into the guide bore above the second seal ring 19. To the contrary, during one-step pushing action of the valve pin 13 or during two-step pushing action of the valve pin, which actions will be fully described later, the orifice passageway 22*b* opens into the fixed-quantity chamber 21 below the second seal ring 19. The orifice passageway 22*b* is formed in the valve pin 13 at a predetermined axial position as set out above. The valve pin 13 is integrally formed at its bottom end (located inside of the gas bottle 11) with a flanged stopper 23 being abuttable with the bottom face of the valve casing 12. The flanged stopper 23 serves to limit upward movement of the valve pin 13 to the maximum permissible upward displacement. Also provided is a notched groove 24 formed on the upper face of the flanged stopper 23. Thus, under a particular condition where the flanged stopper 23 abuts the bottom face of the valve casing 12, the internal space of the gas bottle 11 is communicated with the guide bore 15 through the notched groove 24. The valve pin 13 receives gas pressure in the gas bottle 11 on the bottom face of the flanged stopper 23, and thus the valve pin is normally biased upwards. Also formed on the outer periphery of the valve pin 13 are two annular V-shaped grooves, namely a lower annular V-shaped groove 25 serving as a first bypass portion and axially upwardly spaced apart from the flanged stopper 23 a predetermined axial distance, and an upper annular V-shaped groove 26 serving as a second bypass portion and further axially upwardly spaced apart from the lower V-shaped groove 25 a predetermined axial distance and having the same shape and size as the lower V-shaped groove 25. The axial groove width of each of these V-shaped grooves 25 and 26 is dimensioned to be greater than the seal thickness of the first seal ring 18. The lower V-shaped groove 25 functions to communicate the interior of the gas bottle 11 with the fixed-quantity chamber 21 through a substantially annular internal space (a partial space of the guide bore 15 close to the first seal ring 18) defined between the inner periphery of the first seal ring 18 and the lower V-shaped groove 25 faced each other, only when the valve pin 13 is kept in the lifted-up position. On the other hand, the upper V-shaped groove 26 functions to communicate the interior of the gas bottle 11 with the fixed-quantity chamber 21 through a substantially annular internal space (a partial space of the guide bore 15 close to the first seal ring 18) defined between the first seal ring 18 and the upper V-shaped groove faced each other only when the valve pin 13 is kept in the two-step push position.

Hereupon, the previously-noted one-step push of the valve pin 13 means a comparatively light pushing action or a comparatively shallow pushing action of the valve pin 13 required when gas is injected out of the gas bottle 11 by way of the pushing action of the nozzle button 14. The pushing stroke of the one-step push of the valve pin 13 is restricted by abutment of the stopper face 27 (provided at the bottom face of the nozzle button 14) with the upper face 12*a* of the valve casing 12. On the other hand, the previously-noted two-step push of the valve pin 13 means a comparatively heavy pushing action or a comparatively deep pushing action of the valve pin 13 required when gas is injected or recharged into the interior of the gas bottle 11 through the axial bore of tip of the valve pin 13. As seen in FIG. 3, the pushing stroke of the two-step push is restricted by the injector adapter 28 of a gas recharging device fitted to the tip of the valve pin 13 instead of the nozzle button 14. That is to say, the injector adapter 28, used for gas recharging, is equipped on its inner cylindrical hollow section with a seal ring 40 capable of fitting onto the outer peripheral surface of the valve pin 13. The bottom face of the injector adapter 28 is formed as a stopper face 29. Under a particular condition where the injector adapter 28 is fitted to the tip of the valve pin 13, when the valve pin 13 has been pushed down to the previously-noted two-step push position, the maximum pushing stroke of the valve pin 13 is restricted by abutment between the stopper face 29 and the upper face 12*a* of the valve casing 12.

With the previously-described arrangement of the gas injection valve 10, in a steady state where the pushing action of the nozzle button 14 is not made, the valve pin 13 is held at its lifted-up position shown in FIG. 1, by the gas pressure in the gas bottle 11. The orifice passageway 22*b* of the valve pin 13 is positioned above the second seal ring 19 in a manner so as to block fluid communication between the gas passage bore 22 and the fixed-quantity chamber 21. At this time, the lower V-shaped groove 25 of the valve pin 13 is positioned in such a manner as to face the first seal ring 18, and thus the fixed-quantity chamber 21 communicates with the interior of the gas bottle 11 through the V-shaped groove 25 and the notched groove 24 formed in the flanged stopper 23. When the nozzle button 14 is pushed down from the aforementioned condition, as seen in FIG. 2, the lower V-shaped groove 25 of the valve pin 13 is displaced downwards from the first seal ring 18, and as a result the fluid communication between the interior of the gas bottle 11 and the fixed-quantity chamber 21 is blocked by means of the first seal ring 18. At this time, the orifice passageway 22*b* of the valve pin 22*b* opens into the fixed-quantity chamber 21 below the second seal ring 19. As a result of this, the fixed amount of gas and high-pressure gas and contents such as a medicine is completed. As soon as the pushing action of the injector adapter 28 of the recharging device is released, the valve pin 13 is recovered again to the lifted-up position by virtue of the gas pressure in the gas bottle 11. With the valve pin recovered to its lifted-up position, the orifice passageway bore 22*b* is placed above the second seal ring 19, and as a result the fluid communication between the gas passage bore 22 and the fixed-quantity chamber 21 becomes blocked. Thereafter, the injector adapter 28 is removed from the upper end of the valve pin 13 and then the nozzle button 14 is fitted again to the tip of the valve pin 13. As discussed above, the rebottling of the gas bottle freshly recharged with high-pressure gas and contents is completed.

As will be appreciated from the above, although the gas injection valve 10 of the invention has a very simplified valve structure, it is possible to easily recharge gas and contents into the gas bottle 11, and thus enables the recycling of the gas bottle 11 and the gas injection valve 10. This avoids undesired increase in production costs and thus ensures efficient use of earth resources.

Hereunder described in detail by reference to FIGS. 4 through 9 are the second to fifth embodiments of the gas injection valve of the invention. The fundamental structure of these embodiments is similar to that of the first embodiment shown in FIGS. 1 through 3. The second to fifth embodiments are different from the first embodiment, in that the structure of the first and second bypass portions formed in the valve pin 13 employed in the gas injection valve of each of the second to fifth embodiments is slightly different from that of the first contents captured in the fixed-quantity chamber 21 can be injected into the exterior of the gas bottle 11 through the gas passage bore 22 of the valve pin 13. The downward displacement of the valve pin 13 is limited to the specified pushing stroke of the one-step push by way of abutment of the stopper face 27 of the nozzle button 14 with the upper face 12*a* of the valve casing 12.

When the gas and contents charged in the gas bottle 11 become empty by the frequent use of the gas bottle, for the recycling or rebottling purpose of the gas bottle, the nozzle button 14 fitted to the tip of the valve pin 13 is first removed, and then the injector adapter 28 of the gas recharging device is fitted onto the upper end of the valve pin in place of the nozzle button 14. Thereafter, as seen in FIG. 3, the injector adapter 28 is pushed down until its stopper face 29 is brought into abutted-engagement with the upper face 12*a* of the valve casing 12. Under such a condition, the delivery or recharging of the high-pressure gas and contents stored in the gas recharging device can be attained. That is, the valve pin 13 can be displaced down to the two-step push position by way of the pushing action made with respect to the injector adapter 28. At this time, the orifice passageway 22*b* opens into the fixed-quantity chamber 21 below the second seal ring 19, and additionally the upper V-shaped groove 26 is placed to face the first seal ring 18. Thus, the gas passage bore 22 of the valve pin 13 is communicated with the interior of the gas bottle 11 through both the fixed-quantity chamber 21 and the V-shaped groove 26, with the result that the gas and contents are fed from the gas recharging device, and then recharged into the gas bottle 11. In this manner, the recharging operation of the gas bottle 11 with the embodiment. Thus, the same reference signs used to designate elements of the first embodiment shown in FIGS. 1–3 will be applied to the corresponding elements used in the other embodiments shown in FIGS. 4–9, for the purpose of comparison between the first embodiment and the other embodiments. Only a different structure of the valve pin employed in the injection valve of each of the second to fifth embodiments will be hereinafter described in detail with reference to the accompanying drawings, while detailed description of the same elements as the first embodiment will be omitted because the above description thereon seems to be self-explanatory.

Figure 4:
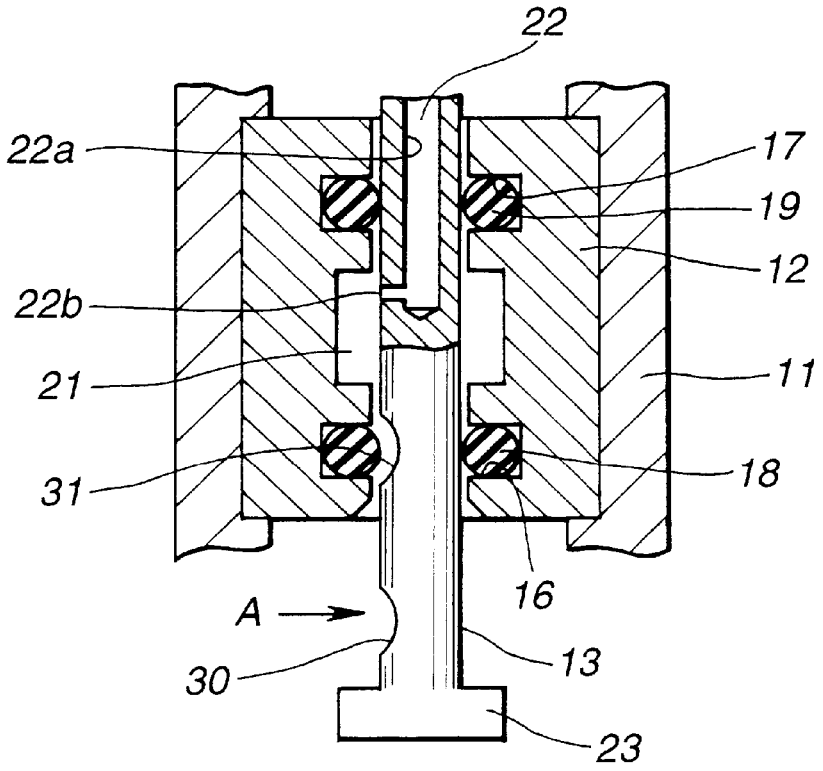
FIG. 4 is a cross-sectional view illustrating a second embodiment of a gas injection valve of the present invention.
Figure 5:
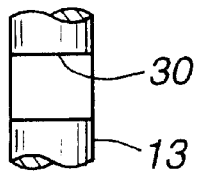
FIG. 5 is a side view in the direction of the arrow A shown in FIG. 4.

Referring now to FIGS. 4 and 5, there is shown the second embodiment of the gas injection valve. The first and second bypass portions of the second embodiment are constructed as respective circular-arc notched grooves 30 and 31 which extend in a direction perpendicular to the axis of the valve pin 13, and are formed on the outer periphery of the valve pin 13 and located at predetermined positions axially spaced with each other.

Figure 6:
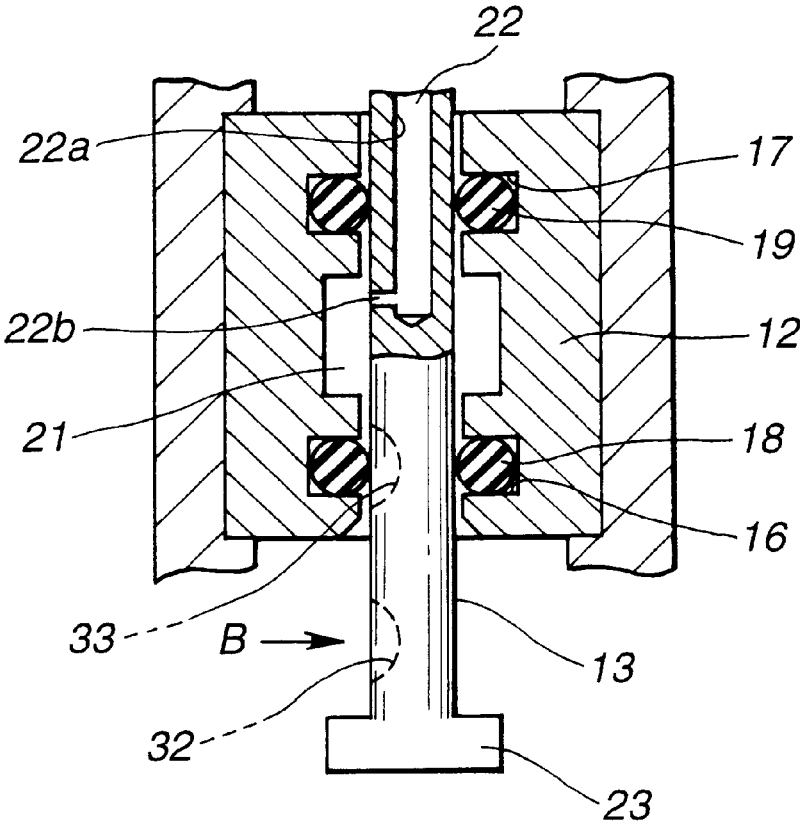
FIG. 6 is a cross-sectional view illustrating a third embodiment of a gas injection valve of the present invention.
Figure 7:
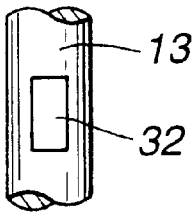
FIG. 7 is a side view in the direction of the arrow B shown in FIG. 6.

Referring now to FIGS. 6 and 7, there is shown the third embodiment of the gas injection valve. The first and second bypass portions of the third embodiment are constructed as respective semi-circular woodruff keyway-like cavities 32 and 33, each having a square opening and the deepest portion at a cavity center thereof.

In the gas injection valves of the second and third embodiments described above, the first and second bypass portions, namely the circular-arc notched grooves 30 and 31, and the semi-circular woodruff-keyway like cavities 32 and 33 are constructed by partly machining part of the outer periphery of the valve pin 13, and whereby the partial machining is more easy as compared to the two-axially spaced V-shaped grooves (of the first embodiment) formed all around the outer periphery of the valve pin 13. The gas injection valve pin structure of the second and third embodiments has an advantage over the valve pin structure of the first embodiment in enabling low-cost production.

Figure 8:
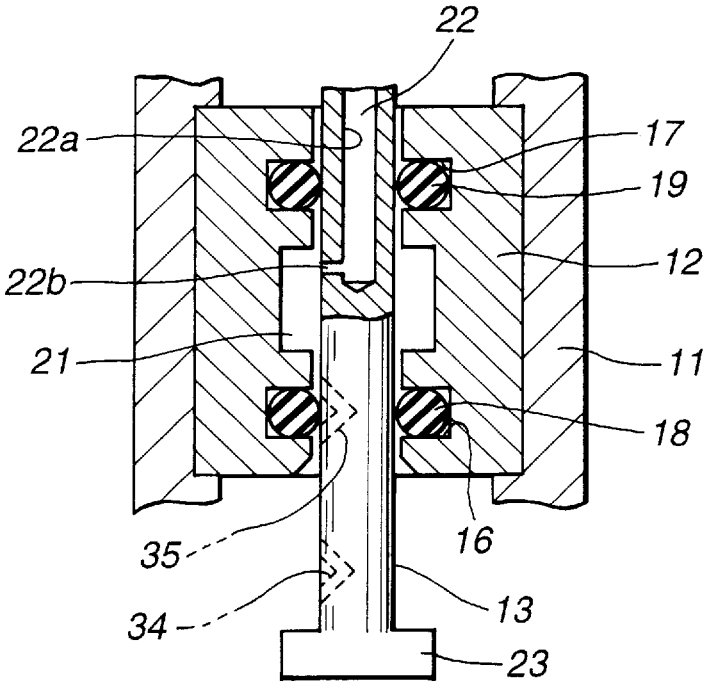
FIG. 8 is a cross-sectional view illustrating a fourth embodiment of a gas injection valve of the present invention.

Referring now to FIG. 8, there is shown the fourth embodiment of the gas injection valve. The first and second bypass portions of the fourth embodiment are constructed as V-shaped bypass passages 34 and 35 which are bored in the valve pin 13 in a manner so as to intercommunicate two different points axially spaced with each other and located on the same vertical line longitudinally extending on the outer periphery of the valve pin 13.

Figure 9:
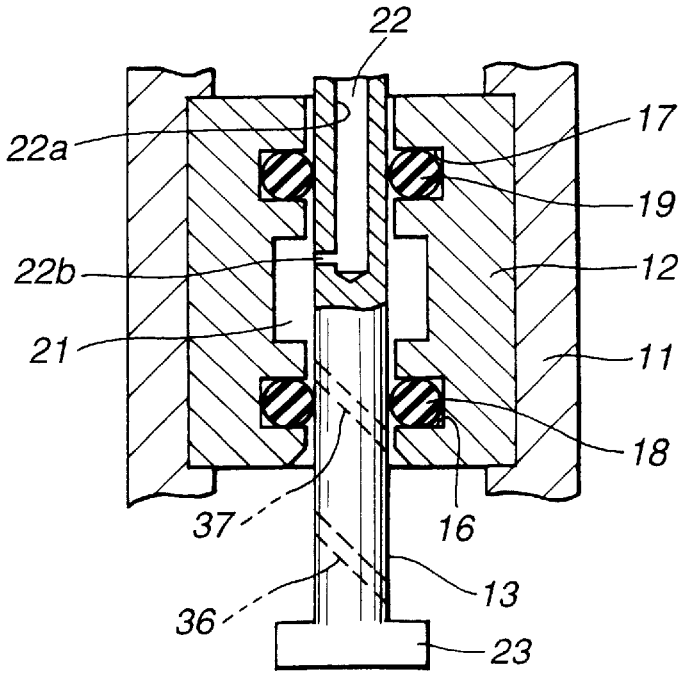
FIG. 9 is a cross-sectional view illustrating a fifth embodiment of a gas injection valve of the present invention.
Figure 10:
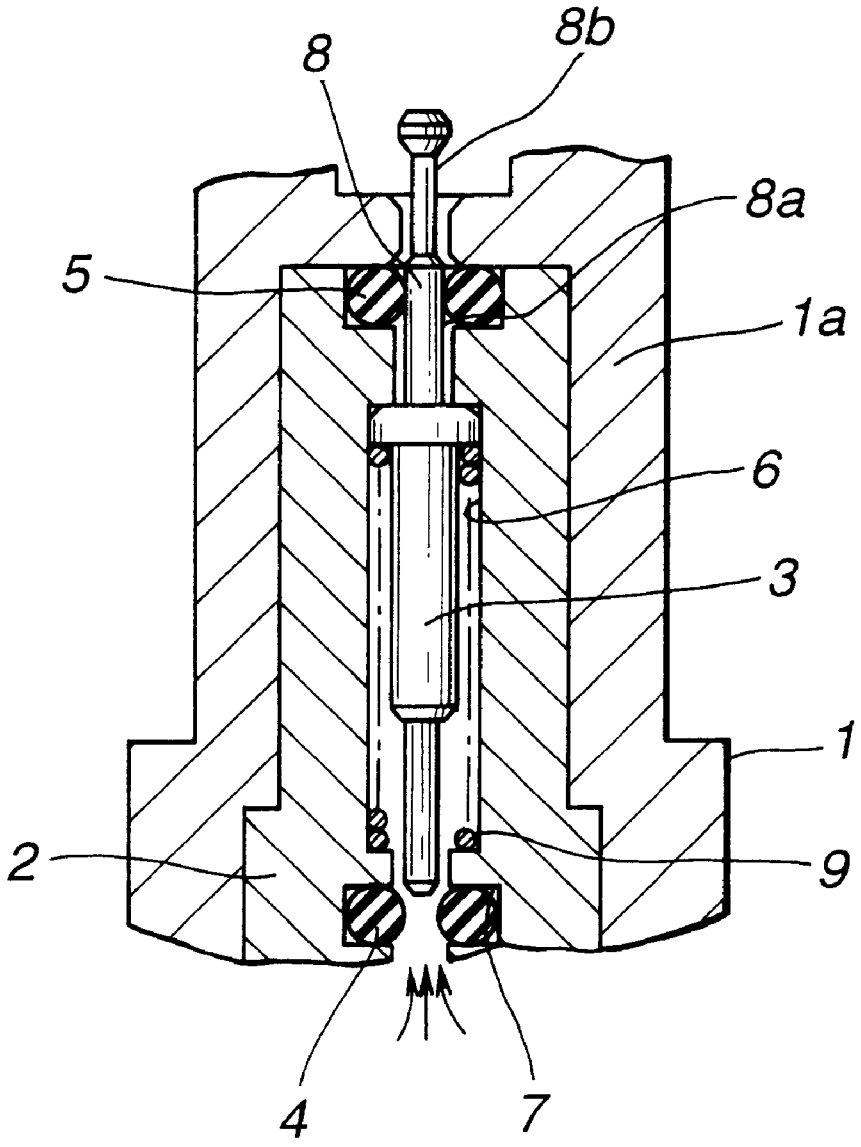
FIG.10 (PRIOR ART)
FIG. 10 is a cross-sectional view illustrating the prior-art gas injection valve and gas bottle.

Referring now to FIG. 9, there is shown the fifth embodiment of the gas injection valve. The first and second bypass portions of the fifth embodiment are constructed as straight bypass passages 36 and 37 which are drilled or bored in the valve pin 13 obliquely to the axis of the valve pin 13 in a manner so as to intercommunicate two different points axially spaced with each other and respectively located on the diametrically-opposing vertical lines longitudinally extending on the outer periphery of the valve pin.

In the gas injection valves of the fourth and fifth embodiments described above, the first and second bypass portions constructed as the V-shaped bypass passages 34 and 35, and the obliquely-extending straight bypass passages 36 and 37 all contribute to reduction in the amount of cut-out portions of the outer periphery of the valve pin 13, thereby reducing undesired wear and tear occurring at the first seal ring 18 due to the sliding motion of the first and second bypass portions (uneven portions on the curved surface of the valve pin 13) synchronously with the axial displacement of the valve pin 13, and thus it is possible to prevent the first seal ring 18 from deteriorating with age. For the reasons discussed above, the gas injection valve structure of the fourth and fifth embodiments using the bypass passage structure formed in the valve pin, has the advantage of enhanced durability of the first seal ring 18.

As set forth above, in the gas injection valve, made according to the invention, comprising a valve casing (12) fitted to the opening portion of a gas bottle (11) and having a substantially cylindrical hollow (15), a valve pin (13) slidably received in the substantially cylindrical hollow of the valve casing, first and second seal rings (18, 19) axially spaced with each other and fitted to the inner peripheral wall of the valve casing to provide sealing action between the inner peripheral wall of the valve casing and the outer peripheral wall of the valve pin, and a fixed-quantity chamber (21) defined in an intermediate portion of the substantially cylindrical hollow sandwiched between the first and second seal rings (18, 19) and capable of capturing therein a fixed amount of gas before injection, the valve pin (13) is formed therein with a gas passage bore (22) through which a first port formed in the uppermost face of the tip of the valve pin (13) is communicated with a second port formed in the outer peripheral wall of the valve pin and axially spaced apart from the first port a predetermined distance. The first seal ring is located closer to the interior of the gas bottle as compared to the second seal ring. The first seal ring provides the sealing action depending on the axial position of the valve pin, whereas the second seal ring permanently provides the sealing action irrespective of the axial position of the valve pin. The second port of the gas passage bore (22) is located to open into the substantially cylindrical hollow (15) above the second seal ring (19) when the valve pin (13) is kept in its lifted-up position, and to open into the fixed-quantity chamber (21) below the second seal ring (19) during a one-step pushing action of the valve pin and during a two-step pushing action of the valve pin. The valve pin (13) also comprises a first bypass portion intercommunicating the interior of the gas bottle (11) and the fixed-quantity chamber (21) through a partial space of the substantially cylindrical hollow near the first seal ring (18) only when the valve pin is kept in the lifted-up position, and a second bypass portion intercommunicating the interior of the gas bottle and the fixed-quantity chamber through the partial space of the substantially cylindrical hollow near the first seal ring (18) only during the two-step pushing action. Therefore, the fixed amount of gas, temporarily captured in the fixed-quantity chamber (21) when the valve pin is kept in its lifted-up position, can be injected or atomized into the exterior of the gas bottle (11) through the gas passage bore (22) formed in the valve pin by virtue of the one-step pushing action of the valve pin (13). Furthermore, with an injector adapter (28) of a gas recharging device fitted to the tip of the valve pin, it is possible to intercommunicate the gas passage bore (22) of the valve pin and the interior of the gas bottle through both the fixed-quantity chamber and the second bypass portion by virtue of the two-step pushing action of the valve pin, and whereby the recharging or rebottling of high-pressure gas (a propellant) and contents stored in the gas recharging device can be efficiently achieved. As set out above, although the gas injection valve (for atomizing) plus injector adapter (for recharging) according to the invention is so simple in structure, the once-used or frequently-used gas bottle of the gas injection device (or the once-used or frequently-used gas injection valve) can be rebottled or recycled several times with new gas and contents stored in the recharging device. This ensures low production cost and also enables the efficient use of earth resources. According to the valve pin structure of the second and third embodiments, each of the first and second bypass portions comprises a notched groove (30, 31; 32, 33) partly formed in the outer peripheral wall (or the curved surface) of the valve pin (13), thus facilitating the machining of each of the first and second bypass portions. This enables remarkable reduction in production costs. According to the valve pin structure of the fourth and fifth embodiments, each of the first and second bypass portions comprises a bypass passage (34, 35; 36, 37) being bored in the valve pin to intercommunicate two different points axially spaced with each other and located on the outer peripheral wall of the valve pin. This reduces undesired wear and tear which may occur at the first seal ring (18) due to the sliding motion of the first seal ring synchronously with the pushing action of the valve pin (13), and consequently enhances the durability of the first seal ring. The gas injection valve according to the invention further comprises a nozzle button (14) capable of being detachably connected or fitted to the tip of the valve pin for atomizing the fixed amount of high-pressure gas and contents temporarily captured in the fixed-quantity chamber (21). The nozzle button (14) has a stopper face (27) restricting or limiting the pushing stroke of the valve pin to a first specified stroke corresponding to the one-step pushing action of the valve pin by way of abutment of the stopper face (27) with the other face. During usual injection of the gas bottle, the fixed or predetermined amount of gas and contents can be certainly injected or atomized from the gas bottle to the exterior, by merely pushing down the nozzle button (14) until the pushing-down motion of the nozzle button is restricted or limited to the predetermined one-step pushing position by the stopper face (27) of the nozzle button. The gas injection valve according to the invention further comprises a gas-recharging injector adapter (28) capable of being detachably connected or fitted to the tip of the valve pin for freshly recharging gas and contents stored in a gas recharging device. The injector adapter (28) has a stopper face (29) for restricting or limiting the pushing stroke of the valve pin to a second specified stroke corresponding to the two-step pushing action of the valve pin by way of abutment of the stopper face (29) with the other face (the upper face of the valve casing 12). During gas recharging, the gas-recharging injector adapter (28) is first fitted to the tip of the valve pin in lieu of the detachable nozzle button (14), and then the recharging action of new gas and contents can easily efficiently be made by merely pushing down the adapter (28) until the pushing-down motion of the adapter is restricted or limited to the two-step pushing position by way of abutment between the adapter stopper face (29) and the other face (the upper face 12*a* of the valve casing).

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

INDUSTRIAL APPLICABILITY

As set forth above, a gas injection valve made according to the invention is useful for the purpose of freshly easily recycling or rebottling a once-used gas bottle with new gas and contents.

What is claimed is:

1. A high pressure gas injection valve, comprising:

a valve casing adapted to be fitted to an opening portion of a gas bottle, said valve casing having a substantially cylindrical valve bore;

a valve pin slidably received in the valve bore, said valve pin having a terminal end exposed to an interior of gas bottle so as be exposed to fluid pressure in the bottle and to be exclusively biased by the fluid pressure toward a closed valve position;

first and second seal rings axially spaced along an inner peripheral wall of of the valve bore to respectively provide seals between an inner peripheral wall of the valve bore and an outer peripheral wall of said valve pin, said first seal ring being located closer to an interior of the gas bottle than the second seal ring;

a fixed-quantity chamber defined in a portion of the valve bore between said first and second seal rings for retaining therein a fixed amount of gas before injection;

a gas passage formed in said valve pin for intercommunicating a first port which is formed in an upper face of a tip of said valve pin with a second port which is formed in the outer peripheral wall of said valve pin and axially spaced apart from the first port by a predetermined distance, the second port of said gas passage being located to open into the valve bore above said second seal ring when said valve pin is in closed valve position and to open into said fixed-quantity chamber below said second seal ring when said valve pin is depressed by a first predetermined amount from the closed valve position against the bias produced bv the fluid pressure, and when depressed by a second predetermined amount which is greater than the first predetermined amount from the closed position;

a first bypass portion formed in said valve pin for intercommunicating the interior of the gas bottle and said fixed-quantity chamber through a space in the valve bore proximate said first seal ring only when said valve pin is kept in the closed valve position;

a second bypass portion formed in said valve pin for intercommunicating the interior of the gas bottle and said fixed-quantity chamber through the space of the valve bore proximate said first seal ring only when the valve pin is depressed bv the second predetermined amount.

2. The high pressure gas injection valve as claimed in claim 1, wherein each of said first and second bypass portions comprise a notched groove formed in the outer peripheral wall of said valve pin.

3. The high pressure gas injection valve as claimed in claim 1, which further comprises a nozzle button detachably connected to the tip of said valve pin for atomizing gas from said fixed-quantity chamber, said nozzle button having a stopper face for limiting the depression amount of said valve pin to the first predetermined amount.

4. The high pressure gas injection valve as claimed in claim 3, further comprising a gas-recharging injector adapter detachably connectable to the tip of said valve pin in place of said nozzle button for recharging gas into the gas bottle, said gas-recharging injector adapter having a stopper face limiting the depression of said valve pin to the second predetermined amount.

5. A high pressure gas injection valve, comprising:

a valve casing adapted to be fitted to an opening portion of a gas bottle, said valve casing having a substantially cylindrical valve bore;

a valve pin slidably received in the valve bore;

first and second seal rings axially spaced along an inner peripheral wall of of the valve bore to respectively provide seals between an inner peripheral wall of valve bore and an outer peripheral wall of said valve pin, said first seal ring being located closer to an interior of the gas bottle than the second seal ring;

a fixed-quantity chamber defined in a portion of the valve bore between said first and second seal rings for retaining therein a fixed amount of gas before injection;

a gas passage formed in said valve pin for intercommunicating a first port which is formed in an upper face of a tip of said valve pin with a second port which is formed in the outer peripheral wall of said valve pin and axially spaced apart from the first port by a predetermined distance, the second port of said gas passage being located to open into the valve bore above said second seal ring when said valve pin is in closed valve position and to open into said fixed-quantity chamber below said second seal ring when said valve pin is depressed by a first predetermined amount from the closed valve position, and when depressed by a second predetermined amount which is greater than the first predetermined amount from the closed position;

a first bypass portion formed in said valve pin for intercommunicating the interior of the gas bottle and said fixed-quantity chamber through a space in the valve bore proximate said first seal ring only when said valve pin is kept in the closed valve position; and a second bypass portion formed in said valve pin for intercommunicating the interior of the gas bottle and said fixed-quantity chamber through the space in the valve bore proximate said first seal ring only when the valve pin is depressed by the second predetermined amount; and wherein each of said first and second bypass portions comprises a bypass passage bored in said valve pin to intercommunicate two different points which are axially spaced with respect to each other and which are located on the outer peripheral wall of said valve pin.

6. A high pressure gas injection valve, comprising:

a valve casing fitted into an opening portion of a gas bottle, said valve casing having a valve bore;

a valve pin slidably received in the valve bore;

first and second seal rings axially spaced with respect to each other along the valve bore wall to respectively provide first and second seals which engage a peripheral wall of said valve pin, said first seal ring being located closer to an interior of the gas bottle than the second seal ring;

a chamber defined in the valve bore between the first and second seal rings for retaining a fixed amount of high pressure gas prior ejection;

a gas passage bore formed in said valve pin for intercommunicating a first port formed in an upper face of a tip of said valve pin and a second port formed in the outer peripheral wall of said valve pin and axially spaced apart from the first port by a predetermined distance, the second port of said gas passage bore being located to open into the substantially cylindrical hollow above said second seal ring when said valve pin is depressed from a closed valve position by a first predetermined amount and to open into said fixed-quantity chamber below said second seal ring when the valve pin is depressed from the the closed valve position by a second predetermined amount which is greater than the first predetermined amount;

a first bypass portion formed in said valve pin for intercommunicating the interior of the gas bottle and said fixed-quantity chamber when said valve pin is depressed by the first predetermined amount;

a second bypass portion formed in said valve pin for intercommunicating the interior of the gas bottle and said fixed-quantity chamber when the valve pin is depressed by the second predetermined amount; and a flanged stopper formed at a bottom end of said valve pin and is abuttable with a bottom face of said valve casing to limit upward movement of said valve pin.

7. A high pressure gas injection valve, as claimed in claim 6, further comprising: a notched groove formed in one of i) an upper face of said flanged stopper and ii) a lower face of the valve casing, for communicating the interior of the gas bottle and said first bypass portion when said valve pin is kept in the lifted-up position.

* * * * *